US005397241A

United States Patent [19]

Cox et al.

[11] Patent Number: 5,397,241

[45] Date of Patent: Mar. 14, 1995

[54] HIGH DENSITY ELECTRICAL CONNECTOR

[75] Inventors: Loren A. Cox, Harrisonville, Mo.; Michael G. German, Secaucus; Constance R. Pallas, Parsippany Township, Morris County, both of N.J.

[73] Assignee: AT&T Corp., Murray Hill, N.J.

[21] Appl. No.: 140,910

[22] Filed: Oct. 25, 1993

[51] Int. Cl.[6] ..... H01R 9/09

[52] U.S. Cl. ..... 439/79; 439/63

[58] Field of Search ..... 439/78–83, 439/62, 63, 578

[56] References Cited

U.S. PATENT DOCUMENTS

| | | | |
|---|---|---|---|
| 4,659,155 | 1/1987 | Walkup et al. . | |
| 4,871,321 | 10/1989 | Johnson | 439/79 |
| 4,946,392 | 8/1990 | Kobler et al. | 439/63 |
| 5,037,314 | 8/1991 | Bricaud et al. | 439/79 |
| 5,044,994 | 9/1991 | Van Woensel | 439/681 |
| 5,090,912 | 2/1992 | Zell | 439/79 |
| 5,169,343 | 12/1992 | Andrews | 439/63 |

*Primary Examiner*—Larry I. Schwartz
*Assistant Examiner*—Hien D. Vu
*Attorney, Agent, or Firm*—Lester H. Birnbaum

[57] ABSTRACT

Disclosed is a high density connector for providing electrical connection between a circuit pack and backplane. The connector is formed from at least two modules, each coupled to a different surface of the circuit board and having a different array of connection types.

7 Claims, 3 Drawing Sheets

HIGH DENSITY ELECTRICAL CONNECTOR

BACKGROUND OF THE INVENTION

This invention relates to electrical connectors.

In many types of systems, it is necessary to electrically couple a circuit pack, which includes a circuit board with electrical components mounted thereon, to a backplane, which includes an insulating surface and an array of pins electrically coupled to other portions of the apparatus. The typical type of electrical connection employed is the signal pin and socket arrangement, but fiber optic and coaxial cable connections may also be included. (See, for example, *AT&T Connector Systems Printed Circuit Board Connector Catalog*, pp. 35 and 45 (March 1990).

As systems have become more complex, high density connectors have become a necessity for economical interconnection. For example, one approach has suggested providing connector pin-in-socket modules which are mounted to different sides of the circuit pack circuit board. (See, e.g., U.S. Pat. No. 4,871,321 issued to Johnson and U.S. Pat. No. 4,659,155 issued to Walkup et al.) The leads of the connectors may be either surface mounted or press-fit into the boards. In the case of press-fit leads, it is desirable to interdigitate the leads from both sides of the board in order to keep electrical paths relatively short and consistent in length.

SUMMARY OF THE INVENTION

The invention is an electrical connector mounted to a printed circuit board. The connector comprises a first module located adjacent to one major surface of the circuit board. The module includes an insulating housing having a front and back surface and an array of conductive elements of one type mounted therein. A second module is located adjacent to an opposite major surface of the circuit board. The second module includes an insulating housing having a front and back surface and an array of conductive elements of a different type than those in the first module mounted therein.

BRIEF DESCRIPTION OF THE DRAWINGS

These and other features of the invention are delineated in detail in the following description. In the drawing.

It will be appreciated that, for purposes of illustration, these figures are not necessarily drawn to scale.

Detailed Description

Figure 1:
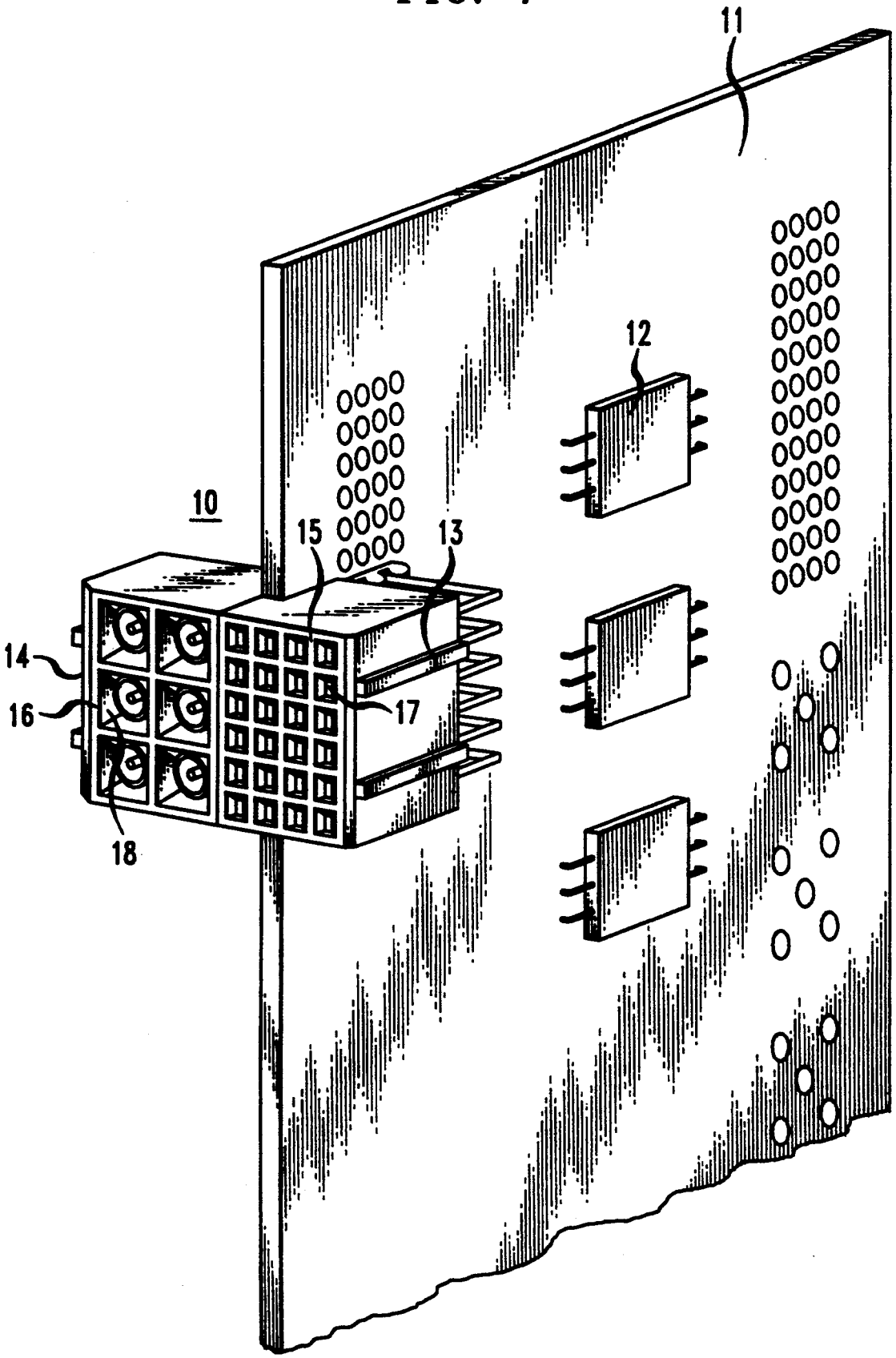
FIG. 1 is a perspective view of a circuit pack including a connector in accordance with an embodiment of the invention.

FIG. 1 illustrates one example of a connector, 10, mounted to a circuit pack which includes a circuit board 11 and a plurality of electronic components, e.g., 12, mounted to at least one surface of the board. The connector 10 includes two separate modules, 13 and 14, which are mounted to the opposite major surfaces of the board 11. Each module includes an insulating housing with a front face, 15 and 16, having an array of apertures, e.g., 17 and 18, respectively.

Figure 2:
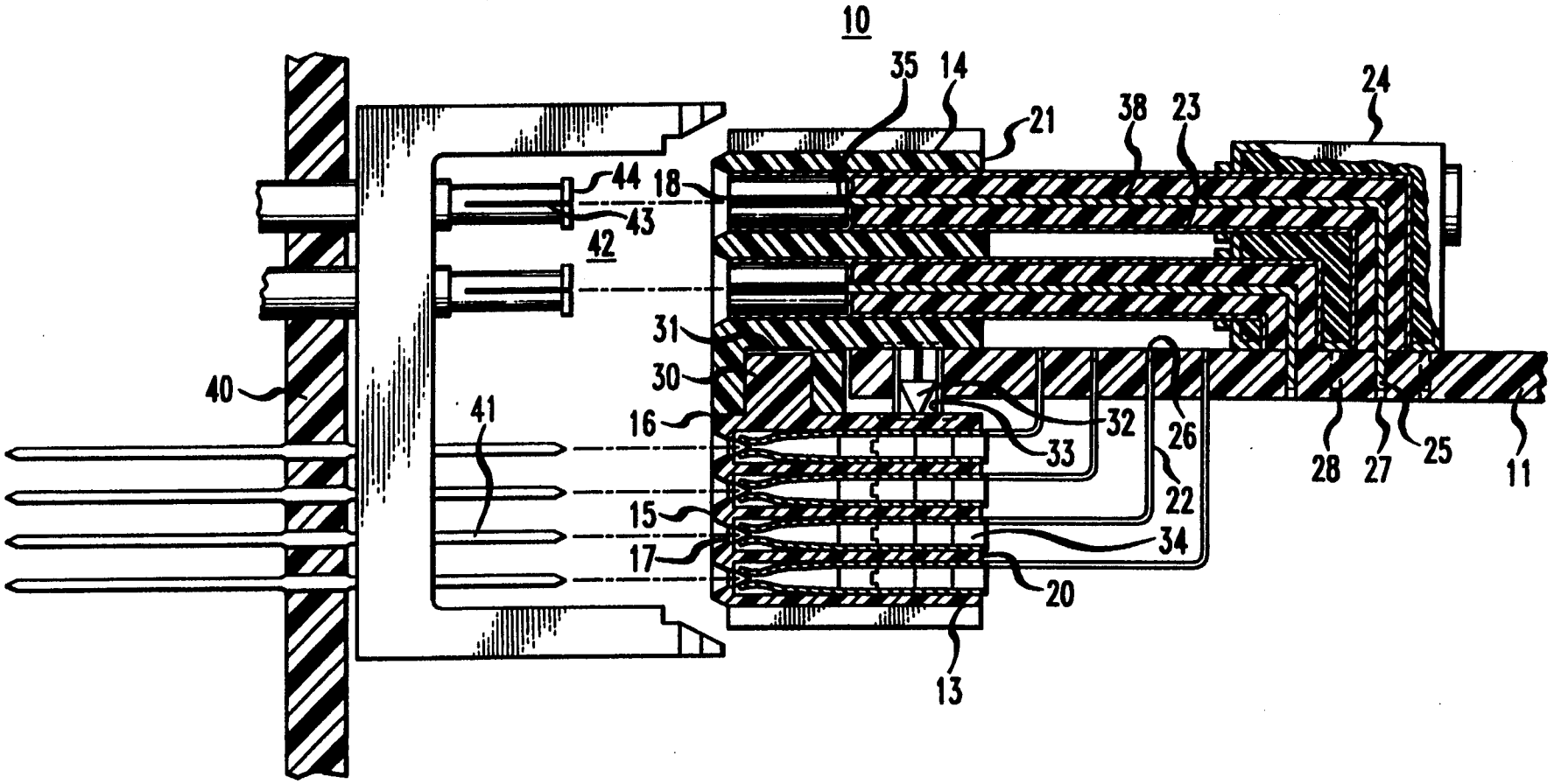
FIG. 2 is a top cross-sectional view of the connector of FIG. 1 along with a backplane illustrating mating of the connector and the backplane.

As shown in FIG. 2, each module, 13 and 14, also includes a back face, 20 and 21, respectively. A plurality of conductive leads, e.g., 22, extend through the back surface, 20, of module 13. A plurality of coaxial connections, e.g., signal conductor 38 and ground conductor 23, extend from the back face of module 14. As shown, the modules are mounted so that the leads of module 13 and the connections of module 14 extend adjacent to opposite major surfaces of the circuit board 11. The connections for module 14 extend a greater distance than the leads of module 13 to a box 24 where the signal and ground connections, e.g., 38 and 23, respectively are bent at fight angles and coupled to leads, e.g., 25 and 28, respectively which extend through the box but are electrically insulated therefrom. The leads, e.g., 25 and 28, from box 24 are press-fit into holes, e.g., 27, in the board. The leads, e.g., 22, from module 13 are also press-fit into holes, e.g., 26, in the board. It will be noted that, in accordance with one feature of the invention, all the leads coupled to one module, 13, are press fit in an area of the board close to the module housing, while all the leads coupled to the other module, 14, are press fit into an area which is farther removed from the module housing. This avoids the necessity of interdigitating the leads from the two modules in the holes of the circuit board.

Alternatively, the leads could be mounted to the circuit board by surface mount techniques where each lead is electrically coupled to a conductive pad on the surfaces of the board.

As also shown in FIG. 2, the modules 13 and 14 are mechanically coupled together by means of a peg 30 which is integral with the housing of one module, 13, extending into an aperture 31 which is integral with the housing of the other module, 14. Desirably, the pegs and holes are positioned in front of the front edge of the circuit board 11. Each module also includes at least one peg, e.g., 32, which is inserted within an aperture 33 in the circuit board so that the module is securely mounted and accurately positioned to the board near the front edge. (See, e.g., U.S. Pat. No. 5,044,994. )

In accordance with a feature of the invention each module, 13 and 14, includes within its housing sockets of a different type than the module adjacent to it on the opposite surface of the circuit board. This feature provides modularity in a plane perpendicular to the plane of the circuit pack to which the connector is attached.

In the embodiment illustrated in FIGS. 1 and 2, the module 13 includes an array of standard pin-receiving sockets, e.g., 34. Each socket is arranged within the module housing aligned with a corresponding opening, e.g., 17, so that the socket will receive and electrically contact a corresponding signal pin, e.g., 41, which is part of an array of pins mounted within a backplane 40. The leads, e.g., 22, which extend out the rear surface 20 of the module are coupled to associated sockets so that electrical connection is provided between the circuit board 11 and the pins of the backplane 40.

The other module, 14, includes an array of coaxial connector-receiving sockets, e.g., 35, within the housing aligned with associated apertures, e.g., 18. The inner portion 38 of the socket mates with and electrically contacts the signal portion, e.g., 43, of an associated coaxial connector 42 mounted to the backplane 40 while the outer portion 23 of the socket mates with and electrically contacts the grounded sleeve portion 44 of the coaxial connector 42. The connections, e.g., 38 and 23, continue out the rear surface of the module where they are coupled through element 24 to appropriate leads, e.g., 27 and 28, so that, ultimately, electrical contact is provided to the circuit board 11 which includes both signal and ground conductive paths (not shown).

Figure 3:
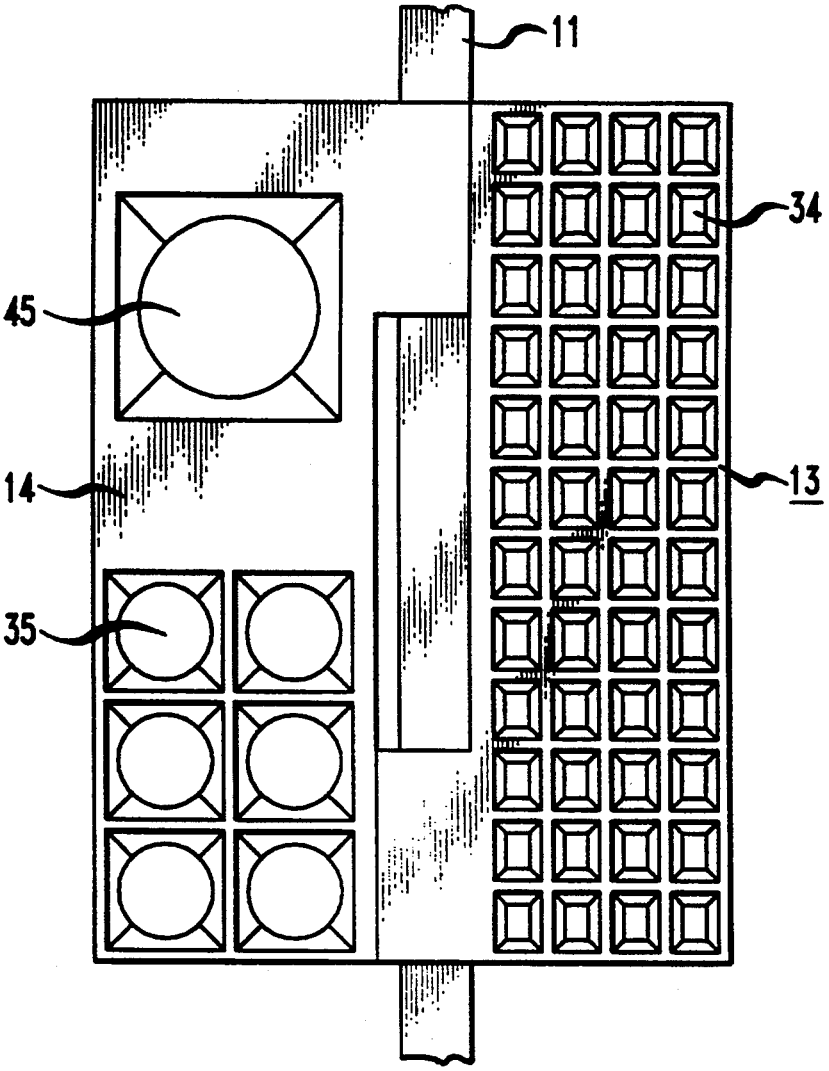
FIG. 3 is a front view of a connector in accordance with a further embodiment of the invention.

At least one of the connector modules, 13 and 14, can combine different types of sockets within one module housing. An example of such an arrangement is illustrated in the front view of FIG. 3 where elements similar to FIGS. 1 and 2 are similarly numbered. Here, a portion of the array of coaxial connector-receiving sockets has been replaced by a socket 45 which is sized to receive a pin (not shown) which transmits the power component to the circuit pack. Sockets adapted for receiving guide pins, optical fibers, or mechanical keying can also be included in the module 14.

It will be appreciated that although the invention has been illustrated with sockets in the circuit pack connector and pins in the backplane, the invention is also applicable to cases where pins extend from the connector and sockets are mounted to a backplane or other structure.

Various additional modifications will become apparent to those skilled in the art. All such variations which basically rely on the teachings through which the invention has advanced the art are properly considered within the scope of the invention.

We claim:

1. An electrical connector mounted to a printed circuit board and comprising:

a first module located adjacent to one major surface of the circuit board and including an insulating housing having a front and back surface, an array of first conductive elements of one type mounted therein, wherein said first conductive elements couple to and a first plurality of right angle electrical leads extending from the back surface and mounted to the one major surface of the circuit board; and a second module located adjacent to an opposite major surface of the circuit board and including an insulating housing having a front and back surface, an array of second conductive elements of a different type than those in the first module mounted therein, wherein said conductive elements extending through the back surface and being bent at right angles, ends of said second conductive elements couple to a second plurality of electrical leads mounted to the opposite major surface of the circuit board, the second plurality of leads and the ends of said second conductive elements being mounted to an area of the circuit board farther removed from the back surfaces of the modules at a greater distance than the first plurality of leads.

2. The connector according to claim 1 wherein the first conductive elements are adapted for signal pin-in-socket connections and the second conductive elements are adapted for coaxial connections.

3. The connector according to claim 2 wherein the first conductive elements are sockets for receiving signal pins therein, and the second conductive elements are sockets for receiving central conductors and surrounding sleeves therein.

4. The connector according to claim 1 wherein the front surface of the first module includes an array of apertures for insertion of signal pins therein, and the front surface of the second module includes an array of apertures for insertion of central conductors and surrounding sleeves therein, said apertures of the two modules having different sizes.

5. The connector according to claim 1 wherein the leads are press fit into holes in the printed circuit board.

6. The connector according to claim 1 wherein the first and second modules are mounted to one another in an area adjacent to an edge of the circuit board by means of a peg-in-hole attachment.

7. The connector according to claim 6 wherein the modules are also mounted to the circuit board by means of pegs within holes in the circuit board.

* * * * *